US006561468B2

(12) United States Patent
Williamson

(10) Patent No.: US 6,561,468 B2
(45) Date of Patent: May 13, 2003

(54) MOUNTING SYSTEM FOR DISPLAYING A BIRD

(76) Inventor: Don Williamson, 93 Zimmerman Rd., Blue Ridge, VA (US) 24064

( * ) Notice: Subject to any disclaimer, the term of this patent is extended or adjusted under 35 U.S.C. 154(b) by 0 days.

(21) Appl. No.: 09/886,236

(22) Filed: Jun. 21, 2001

(65) Prior Publication Data

US 2002/0063191 A1 May 30, 2002

Related U.S. Application Data

(60) Provisional application No. 60/213,506, filed on Jun. 22, 2000.

(51) Int. Cl.[7] ..... A47G 23/02

(52) U.S. Cl. ..... 248/146; 428/542.4; 428/6; 434/296; 434/295; 434/297; 43/3; 43/2

(58) Field of Search ..... 248/146; 428/542.4, 428/16; 434/296, 295, 297; 43/3, 2

(56) References Cited

U.S. PATENT DOCUMENTS 957,750 A * 5/1910 Cunningham ..... 43/3
2,256,778 A * 9/1941 Lundgren ..... 43/3
2,787,074 A * 4/1957 Miller ..... 43/3
2,885,813 A * 5/1959 Kratzert ..... 43/3
3,800,457 A * 4/1974 Barrett ..... 43/3
4,971,865 A * 11/1990 Nowlan ..... 428/542.4
5,248,121 A * 9/1993 Harrington ..... 248/477
5,515,637 A * 5/1996 Johnson ..... 43/2
5,779,294 A * 7/1998 Margri ..... 294/61
6,092,322 A * 7/2000 Samaras ..... 43/2

* cited by examiner

*Primary Examiner*—Kimberly Wood
(74) *Attorney, Agent, or Firm*—Bryan D. Wright

(57) ABSTRACT

An apparatus is provided for mounting and displaying a taxidermy display, usually a bird or fowl. A bird is mounted on a rod appropriately sized to the birds size and weight. Said rod may be bent to effect the desired presentation of the mounted bird. Types of mounts include landing birds, flying birds right and left directions, or others not traditionally used. The bird is secured on the rod eliminating wires for holding the bird and eliminating driftwood as a mounting base. The resulting combination of the rod with its ability to be bent to and then holding the desired position, the affixing of the bird to that rod, and the affixing of the rod to a mounting base which may be securely affixed to a wall provides unsurpassed stability for the mounted bird. The rod being fixedly or adjustably joined to the mounting base also provides a permanent and more stable mounting apparatus than the heretofore unstable methods of mounting birds.

17 Claims, 4 Drawing Sheets

MOUNTING SYSTEM FOR DISPLAYING A BIRD

RELATED U.S. PATENT APPLICATION DATA

Applicant claims priority for this application to U.S. Provisional Application No. 60/213,506 filed on Jun. 22, 2000.

TECHNICAL FIELD

The present apparatus and method relates to the mounting, in various and virtually unlimited positions, of animals preserved through usual taxidermy methods. Although it is anticipated that the disclosed apparatus and method will be used primarily for birds, it may be used for any animal mount.

BACKGROUND OF THE INVENTION

It has been shown that animals, birds in particular, using current taxidermy methods, may be mounted on a wall (or other vertical surface), primarily through the use of wires affixed to a mounting base, sometimes driftwood, which is in turn affixed to the wall. Current methods and apparatuses for mounting such taxidermy mounts are unstable over time. The wires and other unstable mounting devices stretch over time, allowing the mounted animal to sag. In many instances, displays have to be remounted after long periods of time. Moreover, conventional mounting systems do not provide the ability to present the mount in any desired display position. In contrast, the present apparatus differs from all previous methods and apparatuses for mounting animals for display in that the animal can be mounted in any position and permanently affixed to a wall without wires or other unstable connective devices.

The U.S. Pat. Nos. 5,981,004; 5,779,294; 5,248,121; 4,971,865; 3,200,515; 1,844,598 disclose various apparatuses for the mounting of birds and aquatic species. The described apparatus and method, however, differ from the previous efforts to mount animals in several ways. Unlike U.S. Pat. Nos. 5,981,004 and 5,779,294, a bird displayed on the disclosed apparatus by the disclosed method is mounted on a body form through which a rod extends and to which rod the body form is affixed. The disclosed mounting apparatus is then hidden by the mounted bird. Unlike U.S. Pat. No. 1,844,592, in the disclosed apparatus and method, the form on which the bird's plumage is mounted can be made of modern plastic or plastic like materials and mounted on a rod as opposed to secured with wire. Unlike U.S. Pat. No. 3,200,515, the present invention does not incorporate a life sized form of a bird, but simply a molded body insert to be placed in the body cavity.

U.S. Pat. Nos. 4,971,865 and 5,248,121 are drawn to mountings for fish and deer antlers and are inappropriate for mounting birds for display.

Another way in which the disclosed apparatus and method differs from previous apparatuses and methods is that it allows for the mounting of a bird in any conceivable position. Once a position is chosen, the rod is inserted through a hole drilled through the body insert in any direction desired that is suitable for the desired presentation. Moreover, the present invention eliminates wire and driftwood and no special mounting stand is need. Thus, the stability of the mount over time is permanent and unsurpassed by any current art. The ease of mounting birds for display for the present invention is greatly enhanced allowing the taxidermist greater freedom in his artistic presentations as well as reduced cost because of the simplicity of the mount.

In light of these findings, the present apparatus and method differs from previous apparatuses and methods in the manner in which the birds are mounted, in allowing greater flexibility for displaying the mount in varying positions and presentations, and in the ease of use. The present invention is also less costly than current art.

SUMMARY OF THE INVENTION

The present invention relates to a device and method for mounting an animal, primarily birds, and affixing the animal to a mounting base which, in turn, is affixed to a wall or other vertical surface. The device comprises a mounting base, rod, conventional animal body insert, and securing assembly (which affixes the body insert to the rod). In order to practice the method a bird body with plumage attached must be secured by conventional taxidermy methods to the body insert after the hole is drilled through the body insert. The mounting base is affixed to a rod which is passed through a hole in a conventional body form, said hole being drilled or placed in the desired position through the body form so as to effect the desired attitude of the bird in the final display. The body insert, with the plumage attached, is affixed to the rod by the securing assembly. The mounting base may then be affixed to a vertical surface through conventional methods after the mounting of the animal on the disclosed device is completed It is an object of the invention to provide a means for mounting and displaying animals, particularly birds, in any imaginable positional attitude, on a wall or other vertical surface without regard to the texture of the surface.

A principal objective of this invention is to provide a means for mounting and displaying birds, primarily on walls or vertical surfaces. Although the mounting system could be used on any relatively flat surfaces, whether uniform in texture or not. These surfaces could be walls, ceilings, floors, and fireplace portions of any composition.

Another important objective of this invention is to provide a device and method for mounting and displaying birds, giving the taxidermist complete flexibility in the positioning of the display and artistic presentation of the bird. Using this invention, birds may be displayed in traditional manners or in nontraditional manners such as inverted flight, head going toward the wall, head directed away from the wall in a perpendicular fashion, birds in flight, birds not in flight, or any other configuration only limited by one's imagination.

Yet another important objective of this invention is to provide a device and method for mounting and displaying birds which is permanent and not subject to sagging or otherwise degrading over time. Traditional mounting methods using wires do not offer the same stability over time as the present invention.

It is further an objective of this invention is to provide a device and method for mounting and displaying birds or animal prepared by conventional taxidermy methods which is easy to use by anyone with average manual dexterity.

Still another objective of this invention is to provide a simpler device and method for mounting and displaying animals prepared by conventional taxidermy methods.

Another objective of this invention is to provide a less expensive device for the mounting and displaying of birds or animals prepared by conventional taxidermy methods.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

DESCRIPTION OF THE PREFERRED EMBODIMENTS

Figure 1:
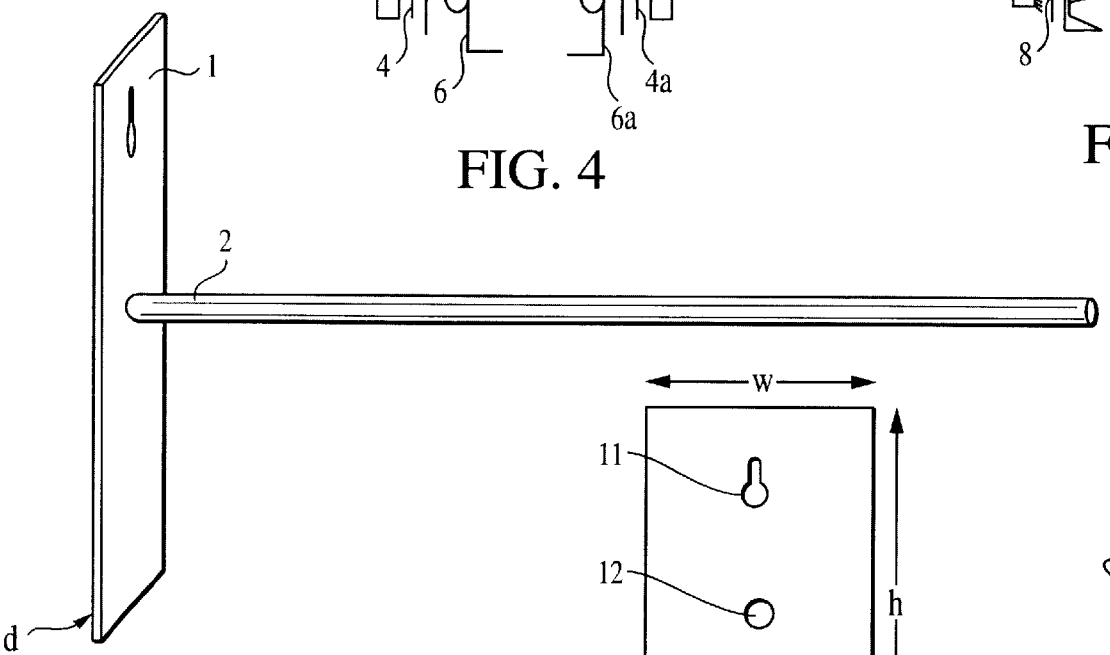
FIG. 1 is a side view of the mounting plate and threaded rod portions of the present invention.
Figure 2:
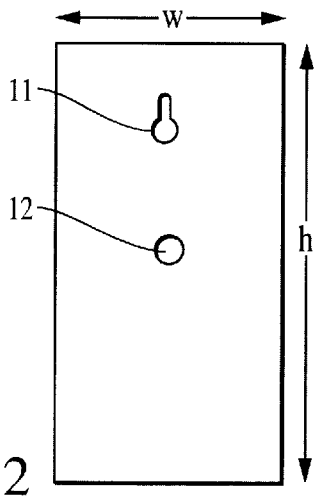
FIG. 2 is a front view of the mounting plate.
Figure 3:
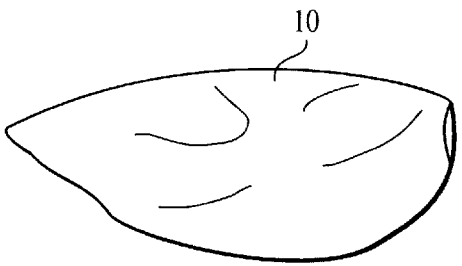
FIG. 3 is a side view of the pre-molded body insert.

For a better understanding of the invention, reference is now made to the drawings. The mounting base 1, shown in FIGS. 1 and 2, is of sufficient size and strength to hold the weight of the bird and to be affixed to the wall. This mounting base, by way of example, could be a metal plate approximately ⅛ inch in thickness d (shown in FIG. 1), and 2 inches in width w by 4 to 8 inches in height h as shown in FIG. 2. The size and shape of the mounting plate 1 may vary depending on the size and weight of the mount. The mounting plate 1 contains a hole or a hole and slot 11 to allow the head of the screw or bolt which ultimately is inserted into the wall to pass through the mounting plate, or upon which the mounting plate 1 can be hung. Further, the mounting plate 1 contains a hole or other portion 12 to which a rod 2 (whether threaded or smooth) may be fixedly connected by conventional means such as welding or adjustably connected by conventional means. A pre-molded or pre-made body form 10 of one of various compositions is provided. The taxidermist drills or pierces a hole through the body form to conform to the desired display juxtaposition of the bird. The rod 2 is left straight or otherwise bent to such a position as desired by the taxidermist. If the rod 2 is bent, sufficient room should be left at the end of the rod to allow it to pass completely through the body insert 10 and allow the Securing Assembly pieces 15 or 16, shown in FIG. 4 or FIG. 5 respectively, to be placed on the rod 2. The angle of the bending of the rod 2 is only limited by the size of the bird and the desired attitude of the display.

Figure 4:
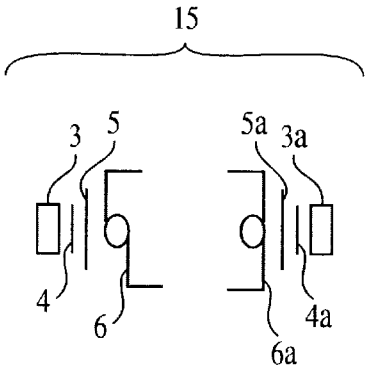
FIG. 4 is a side view of a Securing Assembly which includes bent wire body inserts.
Figure 6:
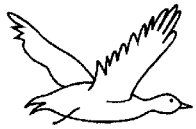
FIG. 6 is a view of one position in which a bird may be displayed.
Figure 7:
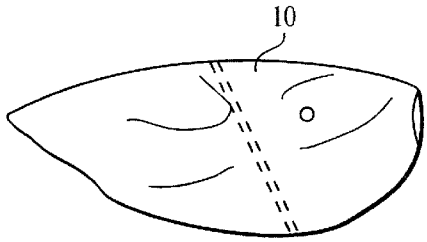
FIG. 7 is a side view of the molded body insert.
Figure 9:
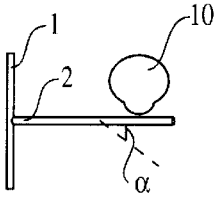
FIG. 9 is a side view of a mounting base and rod, indicating the flexibility of the rod.

Once the desired hole is drilled through the body insert 10, the inside elements of the Securing Assembly 15, FIG. 4, being a nut 3 threaded the same size as the threaded rod 2 is screwed on the threaded rod 2 to a position allowing sufficient room at the end of the threaded rod 2 to place the bird body insert 10 and remaining outside elements (elements 3*a* through 6*a*) of the Securing Assembly 15. Next, a lock washer 4 is slid down the threaded rod 2 next to the nut 3. Next, a flat washer 5 is slid down the threaded rod 2 next to the lock washer 4. Next, a bent wire 6 in the form shown in FIG. 6 is slid down the threaded rod with the protrusions of the wire 6 facing away from the mounting plate 1. The bent wire 6 encircles the rod 2 with each end extending beyond the rod 2 for some distance less than the length of the body insert 10 at which point the ends of the wire are bent perpendicular to the plane of the portion of the wire to encircle the rod. These protrusions are designed to puncture and intrude into the bird body insert 10 which is next slid down the threaded rod and impaled on the bent wire 6. The bent wire 6 and 6*a* is approximately 12-gauge wire. The threaded rod 2 may be of ⅛", 3⁄16", ¼", 5⁄16", or greater diameter (or the metric equivalents), depending on the size and weight of the bird to be displayed. The rod may also be unthreaded with Securing Assembly operatively engaged with the rod member by compression or friction. The following table shows the approximate sizes of various components of the invention to be used for the various sizes and weights of the mounts indicated:

| Mount Size | Size of Mounting Plate | Rod Diameter | Rod Length |
|---|---|---|---|
| Small | 2 in. by 4 in. | ¼ in. | up to 8". |
| Medium | 2 in. by 6 in. | ¼ in. to 5⁄16 in. | 8" to 13" |
| Large | 2 in by 8 in. | 5⁄16 in. to ⅜ in. | 13" to 16½" |
| Extra Large | 2 in. by 8 in. | ⅜ in or larger | 16½"+ |

The Small is best used for: Buffehead, Hooded Merganser, Mandarin Ducks, Goldeneye, Dove, Quail, Ptarmigan, Grouse, Chukar, Small Hawks & Owls, South American Ducks, and most small birds. The Medium Mount Size is best used for: Mallard, Wigeon, Wood Duck, Ruddy Duck, Large Grouse, Small Goose, Pheasant, large Hawks, large Owls, most large North and South American Birds. The Large Mount Size is best used for: Goose and. Turkey. The Extra Large Mount Size is best used for Swan. The use of these sizes of components assure long term stability of the mount.

Next, the outside portion (elements 3*a* through 6*a*) of the Securing Assembly 15 (FIG. 4) is placed on the threaded rod 2 in the following order: the bent wire 6*a* with protrusions pointing toward the mounting plate 1 is slid down the threaded rod and the protrusions from the bent wire 6*a* is thrust into the bird body, the flat washer 5*a* is slid down the threaded rod next to the bend wire 6*a*, following which the lock washer 4*a* and nut 3*a* are screwed on to the threaded rod 2 and secured tightly to hold the bird body insert 10.

Figure 5:
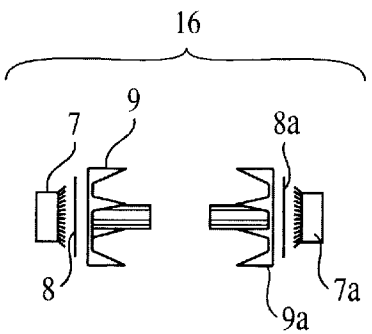
FIG. 5 is a side view of a second preferred Securing Assembly.
Figure 8:
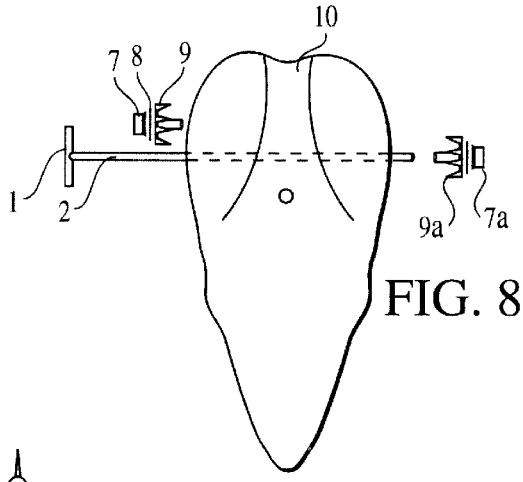
FIG. 8 is a scale bottom view of the components of a complete mount.
Figure 10:
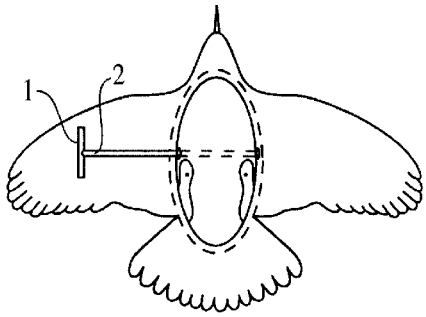
FIG. 10 is a bottom view of a completed mount.
Figure 11:
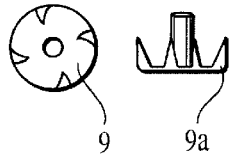
FIG. 11 is a top and side view of the teenut, elements 9 and 9*a* of the Securing Assembly of the second preferred embodiment.
Figure 12A:
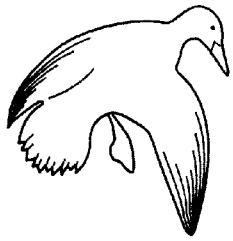
FIG. 12 depicts four different positions and different sized birds which may be mounted using the present invention.
Figure 12B:
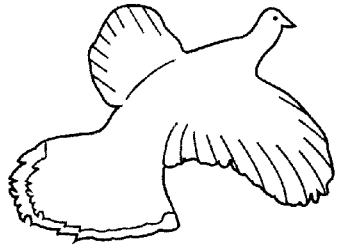
Figure 12C:
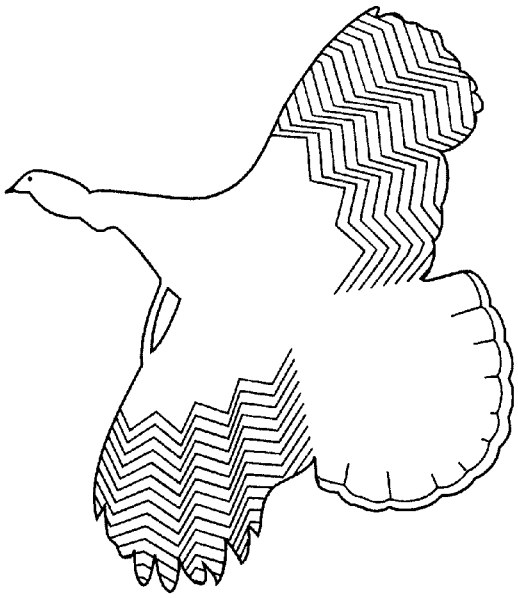
Figure 12D:
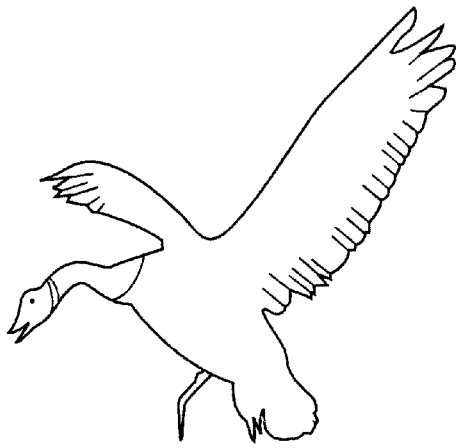
Figure 15:
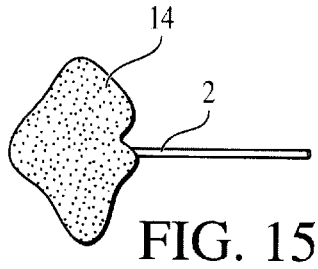
FIG. 15 is a front view of the mounting base and rod showing rock mix applied to hide the mounting base.

A second preferred embodiment of the Securing Assembly 16 is shown in FIG. 5. The following is required to secure the bird body insert 10 to the threaded rod 2 with the use of the Securing Assembly 16 shown in FIG. 5. First, the keepnut 7, a nut with a starwasher fixedly attached to said nut, is screwed down the threaded rod 2 taking care that the washer face is away from the mounting plate 1. A flat washer 8 is then slid down the threaded rod 2 next to the keepnut 7. Next, a threaded teenut 9, commonly used on the bottom of chair legs and which allow the insertion of a threaded adjustable foot, is used in lieu of the bent wire 6. The threaded portion of the teenut 9 must be the same size and diameter as can screw onto the rod 2. The teenut 9, with its metal protrusions facing away from mounting plate 1 is screwed down threaded rod 2 against the flat washer 8. Next, the bird body insert 10, after having the desired hole drilled through it, is slid down the threaded rod 2. Next, the outside elements (7*a* through 9*a*) of the Securing Assembly 16 is placed on the threaded rod. The teenut 9*a* with the metal protrusions facing mounting plate 1 is screwed down the threaded rod 2 and secured into the bird body insert 10 so that the metal protrusions go into the bird body. Next, a flat washer 8*a* may or may not (shown in FIG. 8) be placed next to the teenut 9*a* down the threaded rod 2. Finally, another keepnut with the washer portion toward the mounting plate 1 is screwed down the threaded rod 2 and fixed against either the back of the teenut 9*a* or the flat washer 8*a*, depending on whether a flat washer 8*a* is used in the assembly.

Notwithstanding the use of either preferred embodiment of the Securing Assembly, the mounting and displaying of the bird is completed as follows.

Next, the outside elements of the Securing Assembly (15 and 16) are removed from the threaded rod 2 and the bird body insert 10 is removed from the rod 2. The bird plumage is mounted on the bird body insert 10 in normal taxidermy fashion. However, it is not sewn up. The bird skin is pulled to sewing position, the hole in the body bird insert 10 which is to be closest to the mounting base 1 is then located and a puncture is made in the bird skin with care being taken not to damage the plumage. A scalpel or razor knife is best used for this puncture and it is recommended that the puncture be made in a form of a X. The threaded rod 2, with the inside elements of the Securing Assembly 15 or 16 still attached, is slowly reinserted through the puncture and through the bird body insert 10. The outside elements of the Securing Assembly 15 or 16 are then reattached in the stated order, making sure that the last nut (either 3*a* or 7*a*) is tightened snugly. The skin is then stretched over that nut and the bird skin is sewn up. Final tightening of the innermost nut, 3 or 7, should be made to make sure the bird is secure on the threaded rod 10. To assure that the innermost nut, 3 or 7, remains fixed to the rod, epoxy glue or other conventional glue or metal to metal fusing method may be used to fuse said nut to the rod 2. Likewise, the outermost nut, 3*a* or 7*a*, may be fixed to the rod 2 by epoxy glue or other conventional glue or metal to metal fusing method.

Finally, the bird is hung on a wall with a screw or bolt placed through the mounting hole 11 shown in FIG. 2.

FIG. 12 shows various displays of various sized birds which have been mounted using the disclosed invention.

Figure 13:
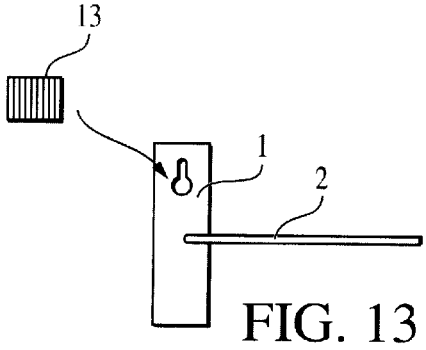
FIG. 13 is a front view of the mounting base and rod in preparation for a modification of the present invention useful for mounting on rock walls, fireplaces, and other uneven vertical surfaces.
Figure 14:
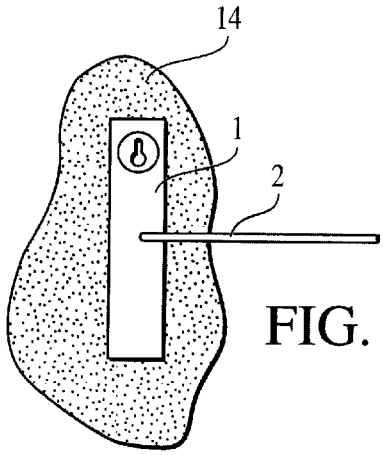
FIG. 14 is a cross-sectional view of the mounting base and rod to which rock mix is applied to hide the mounting base.
Figure 16:
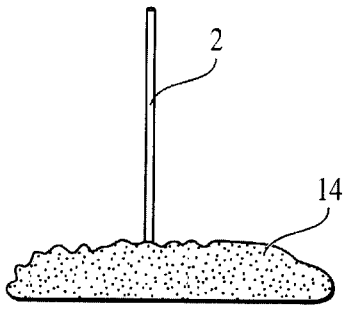
FIG. 16 is a side view of the mounting base and rod showing the rock mix applied.

FIG. 13 shows the temporary addition of a covering 13 for the mounting hole 11. The covering 13 is to keep plaster or rock mix 14 out of the mounting hole 11 after the rock mix 14 has been applied. The mounting base 1 can then be covered by a rock mix 14 or other substance suitable to match the composition of the wall upon which the mount is hung. The rock mix 14 may be painted or otherwise treated suitably to match the background where the complete mount is hung.

The foregoing invention has been described in terms of the preferred embodiments. However, it will be apparent to those skilled in the art that various modifications and variations can be made to the disclosed method and device without departing from the scope or spirit of the invention. The specification and examples are exemplary only, while the true scope of the invention is defined by the following claims.

What is claimed is:

1. A mounting device for displaying an object and mounting the object to a mounting surface, the mounting device comprising:

a mounting base portion for mounting to the mounting surface;

at least one rod member having a threaded rod for engaging with the object, said rod member having a first and second end, said first end being fixedly attached to said mounting base portion;

a first securing means to threadedly affix the object to said rod member, said first securing means located between the object and said mounting base portion;

a pre-molded body insert member having a hole therethrough;

a second securing means for affixing the object to said rod member, said second securing means located at the second end of said rod member;

wherein said first securing means further comprises a threaded nut, at least one washer, and a bent wire shaped to encircle said rod member, said bent wire having two ends extending beyond the portion of the wire to encircle said rod member for some distance less than the length of the body insert member at which point both ends of the wire are bent approximately perpendicular to the plane of the portion of the wire encircling said rod member.

2. The device in claim 1 wherein the second securing means comprises a threaded nut, at least one washer, and a bent wire shaped to encircle the rod member, said bent wire having two ends extending beyond the portion of the wire to encircle said rod member for some distance less than the length of the body insert portion at which point both ends of the wire are bent approximately perpendicular to the plane of the portion of the wire to encircle the rod member.

3. The device in claim 1 wherein the second securing means comprises a threaded nut, at least one washer, and a teenut with metal protrusions.

4. The device in claim 1 wherein said mounting base is configured so as to be removably attachable to a mounting surface.

5. The device in claim 1 wherein said rod member is adjustably attached to said mounting base portion.

6. A mounting device for displaying an object and mounting the object to a mounting surface, the mounting device comprising:

a mounting base portion for mounting to the mounting surface;

at least one rod member having an unthreaded rod for engaging with the object, said rod member having a first and second end, said first end being fixedly attached to said mounting base portion;

a first securing means to unthreadedly affix the object to said rod member, said first securing means located between the object and said mounting base portion;

a pre-molded body insert member having a hole therethrough;

a second securing means for affixing the object to said rod member, said second securing means located at the second end of said rod member;

wherein said first and second securing means are engaged with said rod member by compression or other friction engaging means and wherein said first securing means further comprises a compression nut, at least one washer, and a bent wire shaped to encircle said rod member, said bent wire having two ends extending beyond the portion of the wire to encircle said rod member for some distance less than the length of the body insert member at which point both ends of the wire are bent approximately perpendicular to the plane of the portion of the wire encircling said rod member.

7. The device in claim 6 wherein the second securing means comprises a compression nut, at least one washer, and a bent wire shaped to encircle the rod member, said bent wire having two ends extending beyond the portion of the wire to encircle said rod member for some distance less than the length of the body insert portion at which point both ends of the wire are bent approximately perpendicular to the plane of the portion of the wire to encircle the rod member.

8. The device in claim 6 wherein the second securing means comprises a compression nut, at least one washer, and a teenut with metal protrusions.

9. The device in claim 6 wherein said mounting base is configured so as to be removably attachable to a mounting surface.

10. The device in claim 6 wherein said rod member is adjustably attached to said mounting base portion.

11. A method of mounting an object using a mounting device comprising a mounting base portion which may be electively removably or fixedly attached to a mounting surface, at least one rod member with a first and second end having said first end electively fixedly or adjustably attached to said mounting base portion, , a body insert member, and a first and second securing means each having protrusions comprising the steps of:

fixing the first securing means to the rod member at a desired place on the rod member so that the protrusions of the first securing means point away from the mounting base portion;

inserting the rod member through the body insert member which has been inserted into the object;

impaling the body insert member on the protrusions of the first securing means;

fixing the second securing means at the second end of the rod member so that the protrusions of the second securing means are forced into the body insert member in the object and fixed to the rod member; and handling said mounted object to finish the mount.

12. The method of claim 11 further including the step of providing a hanger attached to a mounting surface to receive said mounting base.

13. The method of claim 11 wherein the step of handling said mounted object includes treating said object.

14. The method of claim 11 wherein the step of handling said mounted object includes painting said object.

15. The method of claim 11 wherein the step of handling said mounted object includes painting said mounting base.

16. The method of claim 11 wherein the step of handling said mounted object includes masking said mounting base to match the color and texture of the mounting surface.

17. The method of claim 11 wherein the step of handling said mounted object includes bending said rod member between said mounting base and mounted object to present the mounted object in the desired juxtapostion to the mounting surface.

* * * * *